United States Patent [19]

Lasier et al.

[11] 3,934,307

[45] Jan. 27, 1976

[54] SPRING ADJUSTMENT MECHANISM

[76] Inventors: Thomas R. Lasier; Roy Pollack, 229 N. Homer St., both of Princeton, Ill. 61356

[22] Filed: May 9, 1974

[21] Appl. No.: 468,245

Related U.S. Application Data

[63] Continuation of Ser. No. 263,946, June 19, 1972, abandoned.

[52] U.S. Cl. ..... 16/79; 16/62; 16/69; 16/64

[51] Int. Cl. ..... E05f 1/08

[58] Field of Search ..... 16/49, 52, 62, 69, 70, 16/64, 65, 71, 79, 80, 72, 85

[56] References Cited

UNITED STATES PATENTS

| | | | |
|---|---|---|---|
| 1,475,015 | 11/1923 | Huber | 16/70 X |
| 1,989,908 | 2/1935 | Bohnsack et al. | 16/79 X |
| 2,071,660 | 2/1937 | Schulz et al. | 16/72 X |
| 3,000,043 | 9/1961 | Check | 16/64 |
| 3,078,499 | 2/1963 | Gray et al. | 16/52 |
| 3,714,677 | 2/1973 | Schmid | 16/62 |

*Primary Examiner*—Richard J. Scanlan, Jr.
*Attorney, Agent, or Firm*—Melvin F. Jager

[57] ABSTRACT

An adjustable spring loading mechanism for use in controlling the movement of doors and the like. The mechanism includes a cylinder housing and a piston slideable within the housing. A plurality of biasing means are arranged in the housing in engagement with the piston, and apply individual biasing forces to the piston which cooperate to produce a total resultant biasing force. The biasing means are provided with different effective lengths so as to engage with the piston at different positions in the cylinder and thereby vary the total biasing force.

7 Claims, 3 Drawing Figures

SPRING ADJUSTMENT MECHANISM

This application is a continuation of Serial No. 263,946 filed June 19, 1972 and now abandoned.

This invention relates generally to an adjustable and variable spring loading mechanism.

There is a constant need for improved spring adjustment mechanisms which are variable within a broad spectrum. The need for such mechanisms is particularly prevalent in the door closer field. As well-known by those skilled in the art, the operating requirements for door closers depend upon the physical characteristics of the installation, such as the weight and width of the door to be controlled, and its location within the building. The closing power of the closer therefore must be related not only to the size and weight of the door, but also to the operating environment at a particular location. Since the physical characteristics of doors vary greatly, even in single building installations, it has heretofore been a substantial problem to provide door closers which are individually designed to suit each particular door installation.

Co-pending application Ser. No. 189,316 filed on Oct. 14, 1971 by Thomas R. Lasier and entitled "Spring Adjustment Mechanism" discloses and claims a mechanism to alleviate the foregoing problem. The present invention constitutes an improvement or modification in the spring adjustment mechanism disclosed in that co-pending application.

The spring adjustment mechanism of the present invention is usable as a door closer or the like, and has a broad range of power characteristics which can be adjusted in the field to adapt the mechanism to the requirements of the particular installation. The invention permits, for example, a single adjustable closer design to be made and sold for a wide range of door conditions, and thereby reduces the costs of the closer manufacturer and user. Furthermore, the present invention provides a door closer design which permits a substantial increase in potential biasing power of the unit without a substantial increase in size, weight, or manufacturing costs. The present invention, due to its adjustability in the field, also allows great versatility in the choice of door closer operating characteristics and power curves (e.g., closing force measured against the degree of door opening).

Briefly described, the mechanism of the present invention comprises a cylinder housing embodying a slideable piston. A biasing mechanism is provided in the housing for urging the translation of the piston in the cylinder. The biasing mechanism comprises a plurality of biasing means, such as compression springs, which are extended in the housing for engagement with the piston and arranged to apply individual biasing forces to the piston. The individual biasing forces join to produce a resultant piston-driving force. Load adjustment means are provided in the preferred embodiment to further vary the resultant biasing force on the piston. The length of each biasing means is chosen so that the individual biasing forces are first applied to the piston at different piston positions. The resultant piston-driving force of the biasing means is thereby varied.

Further objects and advantages of the present invention will become more apparent from the following brief description of an embodiment thereof, taken in conjunction with the accompanying drawings, in which.

Figure 1:
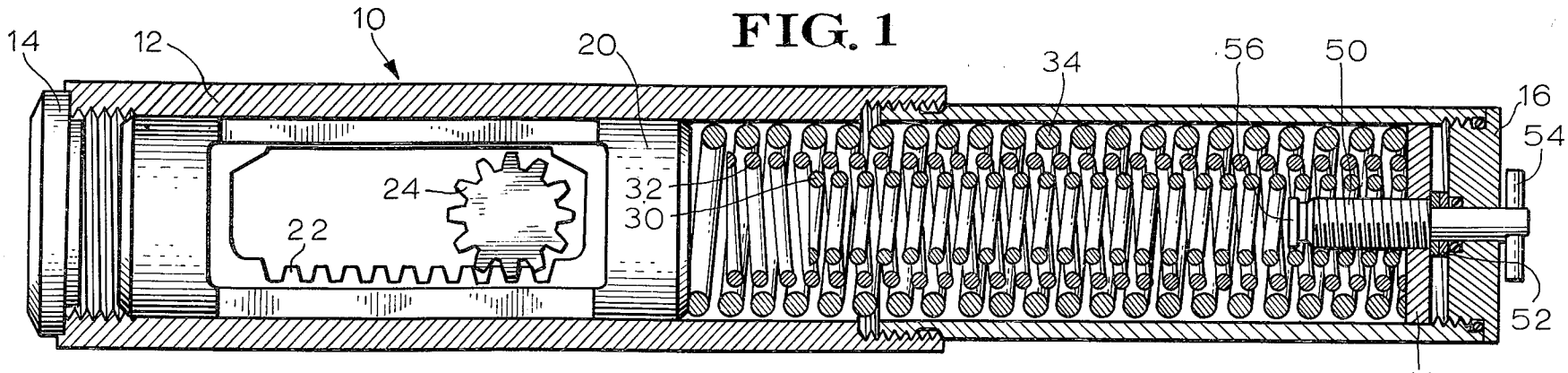
FIG. 1 is a cross-sectional view of a door closer unit embodying the mechanism of the present invention, illustrating the unit in a first adjustment position, prior to the operation of the unit.

The door closer unit embodying the features and advantages of the present invention is generally indicated in the drawings by the reference numeral 10. This closer 10 includes a cylinder housing 12 of standard construction. Removable end caps 14 and 16 seal both ends of the housing 12.

The closer 10 also includes a piston 20 slideably positioned within the cylinder housing 12. In the illustrated embodiment, the piston 20 includes a rack 22 which engages with the gear teeth on a rotatable pinion 24. As well known by those skilled in the art, this arrangement permits the rotational motion of pinion 24 to be converted into translating movement of the piston 20 within the cylinder 12, and vice versa. Accordingly, a door control arm or other suitable linking mechanism (not shown) can be connected to the pinion 24 so that the movement of the door being controlled is interrelated to the sliding movement of the piston 20 within the cylinder 12. Specifically, in the illustrated embodiment the opening of a door would cause counterclockwise rotation of the pinion 24. The pinion 24 in turn acts through the rack 22 to slide the piston 20 to the right within the cylinder 12, as illustrated in FIG. 1. In the same regard, a force applied to the piston 20 urging the piston to the left in FIG. 1 would operate through the rack 22 and pinion 24 to close the door.

In accordance with this invention, the closer unit 10 includes an adjustable biasing mechanism for urging the translation of the piston 20 in the cylinder 12, to thereby urge an opened door closed under controlled conditions. In this regard, the illustrated unit 10 is provided with a plurality of biasing means in the form of nested compression springs 30, 32 and 34, as clearly shown in FIG. 1. The springs 30, 32 and 34 in accordance with this invention are provided with selectively different lengths. Each spring thus initially engages the piston 20 at a different selected location for the piston within the housing 12. The springs 30, 32 and 34 thereby cooperate, at selected stages of operation for the unit 10, to create a resultant biasing force which urges the piston 20 to the left in the drawings. The length and number of springs used in the unit 10 hence can be selected to provide the spring rate and other operating characteristics of the combined springs to suit the needs of a particular application. The springs 30, 32 and 34 are extended in the cylinder 12 toward the cap 16, with one end of each spring positioned for engagement with the piston 20 as the piston translations within the cylinder 12.

The closer unit 10 in accordance with this invention also includes an adjustment mechanism for varying the operating characteristics of each of the springs 30, 32 and 34, to thereby proportionately vary the resultant door closing forces applied to the piston 20. Accordingly, the unit 10 includes an annular adjustment member 40 which is positioned within the cylinder 12 adjacent the end cap 16. The member 40 is co-axially arranged generally along the axis of the cylinder 12, and is in engagement with the concentric nested springs 30, 32 and 34. The axial position of the member 40 can be adjusted to provide the desired operating characteristics for the springs 30, 32 and 34 in accordance with this invention.

The closer 10 also includes adjustment means in the form of a screw shaft 50 for translating the member 40 in the manner described above. As illustrated in the drawings, the shaft 50 extends through the end cap 16 of the unit 10, and is threadably engaged with the member 40. A suitable bearing and seal combination 52 in the end cap 16 permits the shaft 50 to be rotated freely during the operation of the adjustment mechanism. Further, a nut 54 is provided on the outer end of the shaft 50 so that the shaft can be readily rotated from the outside of the unit 10. A shoulder 56 on the shaft 50 defines the limit of axial translatory advance of the member 40 along the shaft 50.

The operation of the door closer 10 is evident from the above description. Briefly, the initial position for the adjustable door closer 10 in a first adjustment position is the position illustrated in FIG. 1. In that initial position, the adjustment screw 50 is set so that the adjustment member 40 is in an extreme retracted position (to the right in the drawings). The aligned springs 30, 32 and 34 are thereby extended between the member 40 and the piston 20. At this stage of the operation for the unit 10, the longest and largest spring 34 is the only spring engaged with the piston 20. In the usual circumstance, the spring 34 is provided with a pre-load force which urges the piston 20 to the left in FIG. 1, in this initial position. Under these conditions, the total initial biasing force applied to the piston 20 is the individual spring force of the spring 34. The opening of an associated door, and the resultant counterclockwise rotation of the pinion 24, will cause the piston 20 to move rightward in FIG. 1, in opposition to this biasing force.

Figure 2:
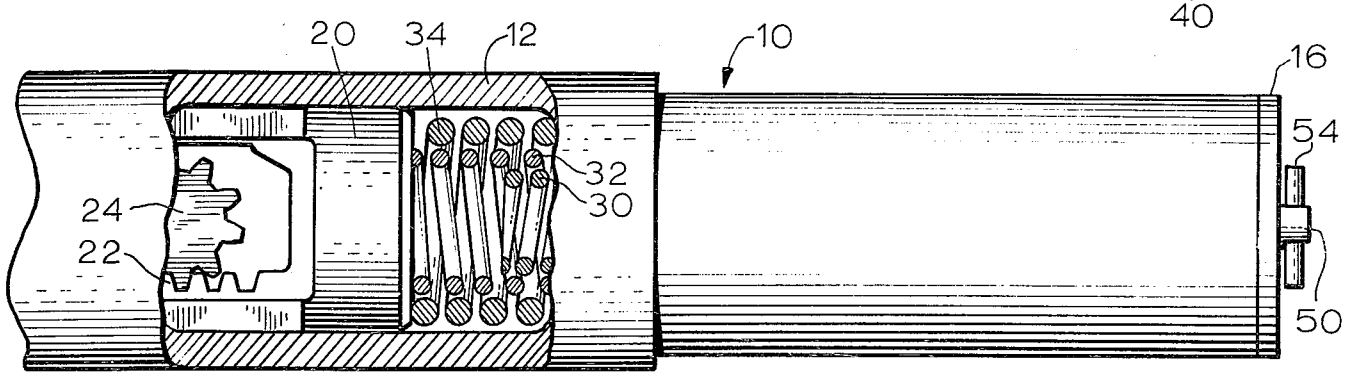
FIG. 2 is a partial sectional view of the closer unit illustrated in FIG. 1, showing the unit in operation in a second position.
Figure 3:
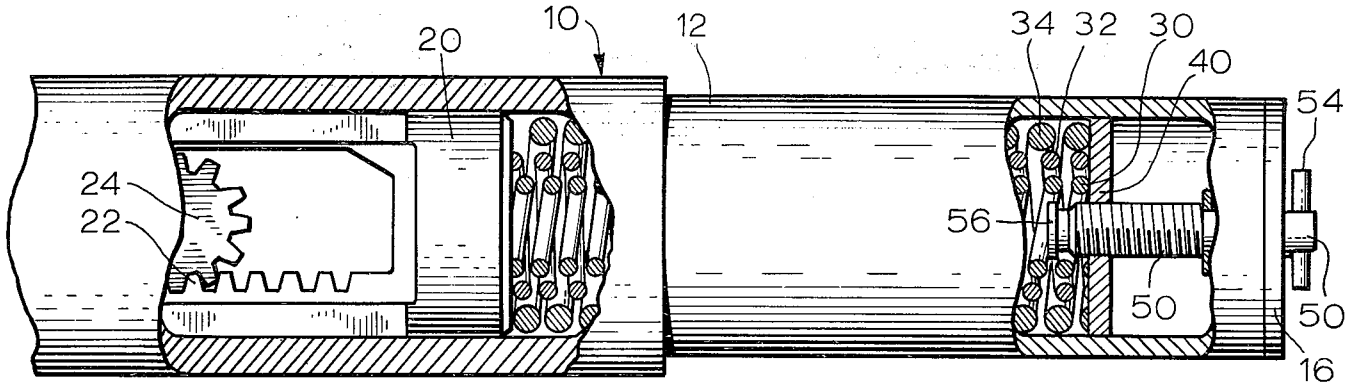
FIG. 3 is a partial sectional view of the door closer unit of FIG. 1, illustrating the unit in operation in a second adjustment position.

Additional springs begin to operate as the associated door is opened further and the piston 20 is advanced rightwardly in FIG. 1. As seen in FIG. 2, a second stage of operation for the unit 10 begins when the intermediate spring 32 engages the piston 20. At this second stage, the resultant biasing force on the piston 20 is the total of the individual spring forces for the springs 34 and 32. Similarly, as seen in FIG. 3, further rightward movement of the piston 20 creates a third stage of operation for the unit 10 by engaging the piston 20 by the smallest spring 30. In this third stage, the resultant biasing force on the piston 20 is the total of the individual spring forces for the three springs 30, 32 and 34.

When the door is released, the stored energy in the compressed springs 30, 32 and 34 will act on the piston 20 to urge the piston in a leftward direction in FIG. 1. Accordingly, the springs 30, 32 and 34 operate to rotate the pinion 24 in a clockwise direction, and thereby urge the associated door to return to its closed condition. The power curve for such a door closing operation depends upon the spring rates, the length and the other physical characteristics of each of the springs 30, 32 and 34. As will be evident to those skilled in the art, the size, power, and other operating characteristics of these springs can be selected and modified to suit the particular design parameters.

In accordance with this invention, the operating characteristics of the door closer 10 can be adjusted in the field to suit the requirements of a particular installation. Accordingly, if the closer 10 is to be employed in an installation requiring additional spring power, the closer 10 may be installed and then adjusted manually by rotation of the nut 54. This operation of the nut 54 rotates the screw shaft 50, and threadably advances the adjustment member 40 longitudinally within the cylinder 12. As illustrated in FIG. 3, this threaded advance of member 40 causes an increase in the compression pre-load force on the aligned compression spring 30. The spring force of the spring 30 is thereby changed. The advance of the member 40 also moves the other springs 30 and 32 toward the piston 20 and changes the location within the cylinder 12 at which the piston engages the springs 30, 32. The total resultant biasing force applied to the piston 20 is thereby proportionately varied. If additional spring power is required for the installation, the adjustment of the nut 54 can be continued until the flange 40a engages with the shoulder 42b.

It will be noted from the above description that the closer 10 in accordance with this invention has great versatility. Because of its adjustable features, it can be used in a variety of installations which would otherwise require individual units with different operating power characteristics. The troublesome matching of a special unit with each field installation is eliminated by permitting easy and quick adjustment of the power rate of the unit in the field. Furthermore, because of the inclusion of the plurality of springs 30, 32 and 34, the individual length and other characteristics of each of the springs can be selected to provide the closer 10 with a desired power curve.

While the embodiment described herein is at present considered to be preferred, it is understood that various modifications and improvements may be made therein, and it is intended to cover the appended claims all such modifications and improvements as fall within the true spirit and scope of the invention.

What is claimed is:

1. An adjustable door closure mechanism adapted for use with a door which is movable between a door closed position and a door open position comprising:

a cylinder housing;

a piston slidable in said cylinder;

means for linking said piston to a door to translate said piston within said cylinder in a selected direction in response to the opening movement of the door;

an adjustable biasing system for producing a resultant door closing force which operates against said piston; said biasing system comprising a plurality of compression spring means having unequal lengths extended within said cylinder and separately engageable with said piston as said piston is translated in said cylinder by the opening movement of the door so that each spring means applies a separate closing force to said piston;

said plurality of compression spring means nested within one of said spring means;

said spring means being arranged within said cylinder in a first condition in which at least one first spring means contacts said piston in the door closed position and at least one second spring means is spaced from said piston in the door closed position;

said second spring means positioned to engage said piston at a selected position as said piston is translated within said cylinder by the opening movement of the door from closed door position whereby said plurality of spring means cooperate to produce a first resultant door closing force permitting said closure mechanism to control the closing movement of the door with a first set of physical characteristics; and closing force adjustment means positioned within said housing for controlling said plurality of spring means to change said separate closing force of said first spring means, to change the location of engagement within said cylinder between said piston and said second spring means as said piston is translated within said cylinder, and to arrange said plurality of spring means in a second condition which causes said separate spring means to cooperate and to produce a second resultant door closing force and thereby to adjust said mechanism for closing a door with a second set of physical characteristics;

whereby said closure mechanism is readily adjustable in the field for use with a plurality of doors having different physical characteristics.

2. An adjustable door closure in accordance with claim 1 wherein said first spring means is provided with a pre-load force against said piston.

3. An adjustable door closure mechanism in accordance with claim 1 wherein said closing force adjustment means is adjustable to arrange said spring means into a plurality of conditions within said housing in the range defined between said first and second adjustment conditions, so that said mechanism is selectively adjustable to produce a plurality of resultant door closing forces between a minimum and a maximum resultant door closing force.

4. An adjustable door closing mechanism in accordance with claim 1 wherein said closing force adjustment means comprises movable abutment means provided within said cylinder and engageable with said spring means to shift said spring means in said cylinder and vary the location of engagement between said piston and at least one said spring means as said piston translates within said cylinder.

5. An adjustable door closure mechanism adapted for use with a door which is movable between a door closed position and a door open position comprising:

a cylinder housing;

a piston slidable in said cylinder;

means for linking said piston to a door to translate said piston within said cylinder in a selected direction in response to the opening movement of the door;

an adjustable biasing system for producing a resultant door closing force which operates against said piston, said biasing system comprising a plurality of compression spring means extended within said cylinder, each of said spring means having different selected lengths and spring rates and a selected initial pre-loading condition, and each further being separately engageable with said piston at selected separate locations of said piston in said cylinder as said piston is translated within said cylinder from the door closed position to door open position whereby each spring means applies a separate closing force to said piston; and a spring load adjustment member adjacent to one end of said springs and arranged to engage each spring, and manually adjustable means connected to said member and operative to translate said member axially against said springs and change the piston position in said cylinder which energizes each spring to thereby change said individual spring biasing force and change the resultant door-closing force.

6. The adjustable door closer in accordance with claim 5 in which said spring means are nested in a substantially concentric arrangement.

7. The adjustable door closer in accordance with claim 5 in which said manually adjustable member includes a shaft extending through one end of said cylinder.

* * * * *